US005255990A

United States Patent [19]

Dornbusch et al.

[11] Patent Number: 5,255,990

[45] Date of Patent: Oct. 26, 1993

[54] RESET ELEVATOR/THREADED SHAFT DISPENSING PACKAGE FOR STICK FORM PRODUCT AND A REFILL CARTRIDGE THEREFOR

[75] Inventors: Arthur H. Dornbusch, Cincinnati; Robert A. Paul, Fairfield, both of Ohio; Calvin S. Cook, Erie, Pa.; Stephen W. Harding, Hamilton, Ohio

[73] Assignee: The Procter & Gamble Company, Cincinnati, Ohio

[21] Appl. No.: 900,638

[22] Filed: Jun. 18, 1992

[51] Int. Cl.[5] ..... A45D 40/06; A45D 40/04

[52] U.S. Cl. ..... 401/68; 401/70; 401/172; 401/174; 401/86

[58] Field of Search ..... 401/68, 70, 75, 172, 401/174, 69, 86

[56] References Cited

U.S. PATENT DOCUMENTS

| | | | |
|---|---|---|---|
| Re. 27,022 | 1/1971 | Fuglsang-Madsen | 401/78 |
| 2,214,090 | 9/1940 | Trollen | 120/18 |
| 2,621,786 | 12/1952 | Schnack | 206/56 |
| 2,626,047 | 1/1953 | Crane | 401/69 |
| 2,630,215 | 3/1953 | Lynn | 206/56 |
| 2,858,937 | 11/1958 | Hoffman | 206/56 |
| 2,913,103 | 11/1959 | Isele | 206/56 |
| 2,921,675 | 1/1960 | Clark et al. | 206/56 |
| 3,115,118 | 12/1963 | Anderson et al. | 401/75 |
| 3,146,881 | 9/1964 | Metreaud et al. | 206/56 |
| 3,317,036 | 5/1967 | Cherba | 206/56 |
| 3,335,854 | 8/1967 | Landen | 206/56 |
| 3,429,643 | 2/1969 | Seaver | 401/75 |
| 4,605,330 | 8/1986 | Crowley et al. | 401/68 |
| 4,950,094 | 8/1990 | Yorks | 401/75 |
| 4,954,000 | 9/1990 | Gueret | 401/174 X |

FOREIGN PATENT DOCUMENTS

| | | | |
|---|---|---|---|
| 548301 | 1/1923 | France | 401/69 |
| 54399 | 9/1949 | France | 401/174 |
| 1219926 | 1/1971 | United Kingdom | 401/75 |
| 2207640 | 2/1989 | United Kingdom | 401/174 |

*Primary Examiner*—Steven A. Bratlie

*Attorney, Agent, or Firm*—Dean L. Garner; E. Kelly Linman

[57] ABSTRACT

An elevator/threaded shaft dispensing package for a solid stick-form product. The package has a refill cartridge designed to telescope into a reusable base. The base is tubular and has a threaded shaft axially oriented within it through a central aperture at its bottom where the shaft is connected to a hand wheel. The cartridge holds the product in a tubular body which preferably has a non-circular cross-section. A push plate is disposed in the bottom of the cartridge and the top of the cartridge preferably has a downwardly extending annular collar on its exterior. The package has a telescoping elevator system disposed within it which includes a platform which abuts against the push plate and an internally threaded neck below the platform. The internally threaded neck receives the threaded shaft in threaded telescoping relation. When the hand wheel is turned in a predetermined direction the elevator system advances towards the top, pushing the product in the cartridge up and out of the package so the consumer can have access. The package is able to reset the elevator to its lowermost position when it is in its uppermost position without manually rotating the hand wheels.

14 Claims, 9 Drawing Sheets

RESET ELEVATOR/THREADED SHAFT DISPENSING PACKAGE FOR STICK FORM PRODUCT AND A REFILL CARTRIDGE THEREFOR

FIELD OF THE INVENTION

This invention relates to packages for dispensing stick-form products. More particularly, the invention relates to such packages having an elevator/threaded shaft dispensing means. The present invention has further relation to such packages having a reusable base adapted to receive a refill cartridge so as to make the package partially reusable.

BACKGROUND OF THE INVENTION

Cosmetic products such as antiperspirants and deodorants are typically packaged in what is referred to as swivel-up or elevator/threaded-shaft dispensing packages. An example of such a package is given in U.S. Pat. No. 4,950,094 issued to Yorks on Aug. 21, 1990. Another example of such a package is described in pending and commonly assigned U.S. application Ser. No. 07/760,661 by Dornbusch et. al. filed Sep. 16, 1991, the disclosure of which is hereby incorporated herein by reference. Such packages typically have a body with an oval cross-section having a threaded shaft axially oriented therein and rotatably mounted at the bottom end through an aperture. This threaded shaft is typically connected to a hand wheel on the exterior of the package's bottom for advancing the stick product out of the package. An elevator or follower is threadably mounted to the shaft on the interior of the package at its bottom. Turning the hand wheel in a predetermined direction will either advance the elevator towards the top of the package or retract it back towards the bottom. The cosmetic product is typically poured into the package in its liquid or molten state, with the elevator in its lowermost position, whereby upon cooling the product solidifies and takes on the shape of the package. Thereafter, to dispense the stick form product from the package one turns the hand wheel thereby rotating the threaded shaft and advancing the elevator towards the top of the package. As the elevator advances toward the top of the package it pushes the stick form product up and out of the top of the package so the user can have access.

Recently, in order to reduce the consumption of natural resources and reduce solid waste landfill volume there has been a desire to make elevator/threaded-shaft dispensing packages partially reusable so that the entire package does not have to be thrown away after the initial product is used up. One way to accomplish this is to design a package that has a reusable base designed to receive a refill cartridge containing the solid stick form product. After the initial product in the package is used up, the initial refill cartridge is discarded and a new a refill cartridge is inserted into the reusable base, thereby rendering the package partially reusable. Applicants do not know of any elevator/threaded-shaft packages designed to be used for antiperspirants or deodorants that employ a refill cartridge. However, refill cartridges for lipsticks have been known for some time.

An example of a refillable lipstick container is disclosed in U.S. Pat. No. 2,921,675 issued to Clark et. al. on Jan. 19, 1960. Clark discloses a tubular lipstick package having what is referred to as a spiral shell propulsion system. A carrier or elevator for the lipstick is propelled upon the relative rotation of two tubular members of a reusable container. The refill cartridge of the Clark invention includes the carrier or elevator as an integral part. When the cartridge is placed in the container the two tubular members need to be rotated in order to retract the lipstick cartridge into the container. For small cosmetic products such as lipstick the container would at most need only about three rotations to bring the lipstick from its uppermost position, when being loaded into the base, to its lowermost position so as to retract the product within the container. However, for larger stick-form products such as deodorants using a typical elevator/threaded-shaft dispensing package, the hand wheel would need to be rotated a number of times in order to take the stick product from its uppermost position to its lowermost position. That is whenever a new cartridge is to be loaded into a reusable base the consumer would need to take the time to rotate the hand wheel a number of times in order to load the cartridge. This is a drawback in that many consumers would rather use a non-reusable package than have to go through so much effort to install a refill cartridge.

An example of of a replaceable lipstick container wherein the lipstick cartridge can be readily pushed into place is disclosed in U.S. Pat. No. 3,429,643 issued to Seaver on Feb. 25, 1969. Seaver discloses a replaceable lipstick container that can use a elevator/threaded-shaft propulsion system for the lipstick. However, the propulsion system of the Seaver invention is self-contained within the disposable cartridge. This means that the threaded-shaft and the elevator are thrown away with the cartridge. This approach does little to minimize solid waste. As many parts of the package as possible should be reusable so that the consumption of natural resources and solid waste land-fill volume is reduced.

Therefore it is an object of the present invention to provide an elevator/threaded shaft dispensing package for cosmetic stick-form products wherein only part of the package is disposable rendering the remainder reusable.

It is another object of the invention to provide such a package having a reusable base designed to receive a refill disposable cartridge wherein a new reusable cartridge containing product can be readily inserted into the base without having to manipulate the hand wheel.

It is another object of the present invention to provide such a package wherein most of the elevator/threaded shaft dispensing system is part of the reusable base and not a part of the disposable refill cartridge.

The aforementioned and other objects of the invention will become more apparent hereinafter.

SUMMARY OF THE INVENTION

In accordance with the present invention there is provided an elevator/threaded shaft dispensing package for a solid stick form product. The package has a cartridge which is designed to telescope into a base. The base has a tubular body having an open top and a closed bottom having a central aperture disposed therein. The base has a threaded shaft axially oriented within its body and rotatably mounted on its bottom through the central aperture. The shaft is connected to a hand wheel on the exterior of the body. The cartridge comprises a tubular body for holding a solid stick form product. The body has an open top and an bottom. The bottom of the cartridge has push plate disposed therein.

The package of the present invention further includes a telescoping elevator system disposed within the base.

The elevator system comprises an internally threaded neck adapted to receive the threaded shaft and a threaded telescoping relationship. The elevator system further includes a platform above the neck designed to abut against the push plate of the cartridge, whereby when the hand wheel is turned in a predetermined direction the shaft rotates advancing the platform and the push plate and thereby advancing the stick product out of the top of the package. Lastly, the package has a means for resetting the elevator to its lowermost position when it is in its uppermost position without manually rotating the hand wheel.

In accordance with another aspect of the present invention there is provided a reusable cartridge for a solid stick-form product. The cartridge is designed to telescope into a reusable base having an elevator/threaded shaft dispensing system. The cartridge has a tubular body for holding the stick-form product. The body extends longitudinally between an open top and an open bottom. The cartridge cartridge body has a non-circular cross-section when taken perpendicular to the longitudinal axis. The cartridge further includes a downwardly extending collar on the exterior of the body. The bottom of the cartridge body has a push plate disposed therein. Lastly, the cartridge includes means for sealing the open top and the open bottom of the body.

BRIEF DESCRIPTION OF THE DRAWINGS

While the specification concludes with claims particularly pointing out and distinctly claiming the subject invention it is believed that the same will be better understood from the following description when taken in conjunction with the accompanying drawings in which: in:

DETAILED DESCRIPTION OF THE INVENTION

Figure 1:
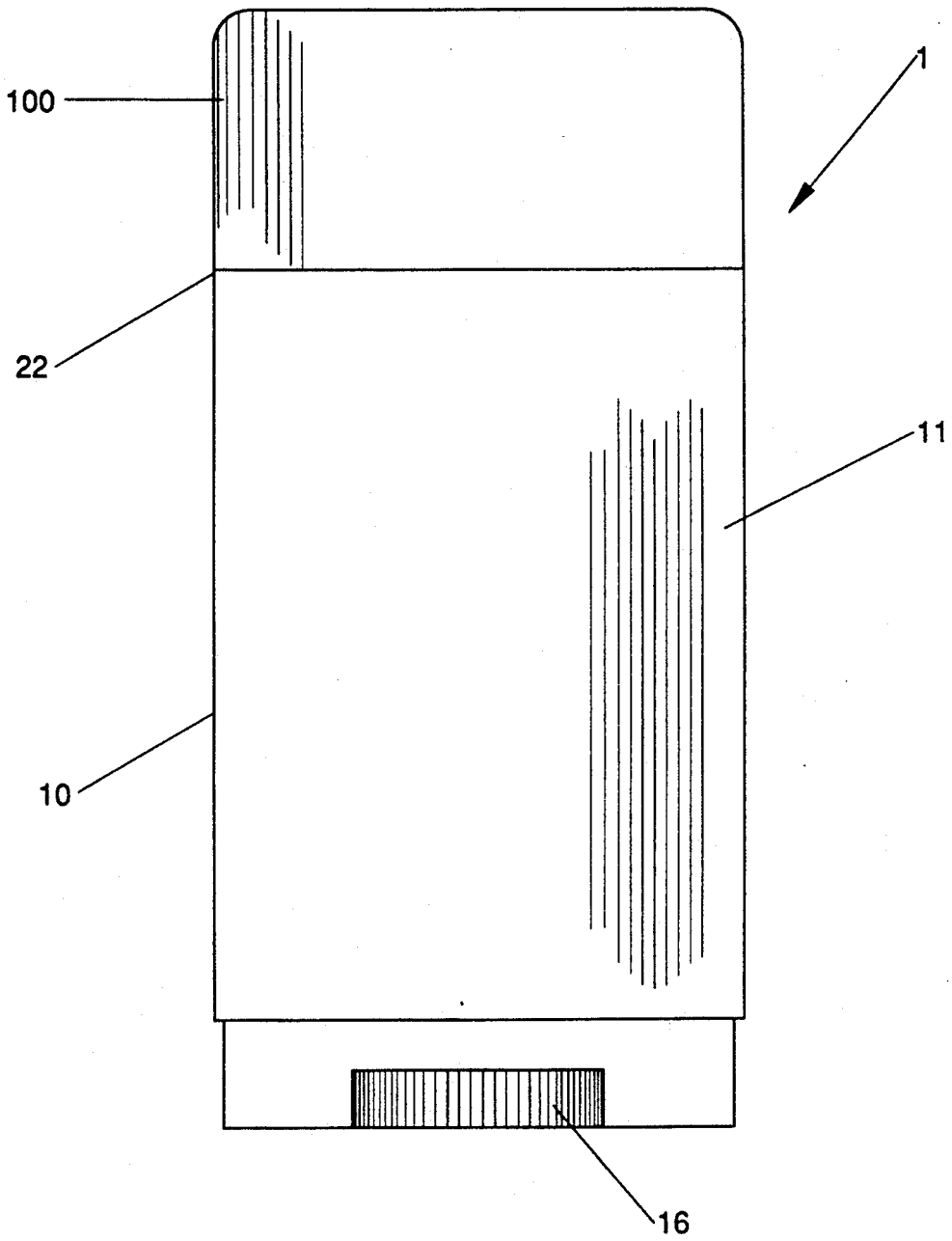
FIG. 1 is a elevational view of the assembled package of the present invention.

Referring to the drawings in detail wherein like numerals indicate the same element throughout the view there is shown in FIG. 1 an elevator/threaded shaft dispensing package 1 for dispensing solid stick-form cosmetic products. Package 1 can be better understood by referring to FIG. 2 which is an exploded view of package 1. As seen from FIG. 2 package 1 comprises base 10, elevator system 30, cartridge 50 and cap 100. Base 10 and elevator system 30 are designed to be reusable, whereas cartridge 50 is designed to be a disposable refill cartridge for containing the stick-form product 51. Cartridge 50 is designed to telescope into reusable base 10. As shown in the Figures it is preferred that both the cartridge 50 and base 10 have oval cross-sections for better consumer application.

Base 10 has a tubular body 11 having an open top 12 and a closed bottom 13. Bottom 13 has central aperture 14 disposed therein. Base 10 further includes a threaded shaft 15 axially oriented within body 11 and rotatably mounted at bottom 13. Shaft 15 extends through aperture 14 where it is connected to a hand wheel 16. Hand wheel 16 is located on the exterior of body 11 adjacent bottom 13. Threaded shaft 15 has annular flange 17 located near its bottom which snap-fits over tabs 18, which are connected to the bottom 13 near aperture 14. This snap-fit arrangement secures threaded shaft 15 in place while allowing it to rotate within body 11.

Base 10 has inwardly stepped sections 20 and 21 adjacent top 12. Stepped section 21 is stepped in further than stepped section 20. Cap 100 is designed to fit over top 12 of base 10 and rests on ledge 22 of stepped section 20 as is shown in FIG. 1. In a preferred embodiment section 21 has two opposing outwardly extending beads 23 and 24. As will be discussed below these beads are used as a means to secure cartridge 50 within base 10. Base 10 can be made from any number of materials including polypropylene and polyethylene.

Package 1 further includes cartridge 50, which comprises tubular body 52 for holding stick-form product 51. Body 52 can be made from any number of materials but it is preferably made from virgin polypropylene as it is less prone to cracking and it gives good product release. Body 52 extends longitudinally between an t 53 and an open bottom 54. It is preferred that body 52 have a non-circular, preferably oval i cross-section when taken perpendicular to its longitudinal axis. Bottom 54 has push plate 60 disposed therein. Push plate 60 preferably has a domed shape, as shown in the figures, to provide comfort at the end of use. Push plate 60 further includes a number of apertures 61 which aid in adhering the product 51 to push plate 60. Push plate 60 may include an annular protrusion, similar to a bead seal, extending around its circumference and pressing against the interior of the body 52 of cartridge 50. This protrusion provides greater friction between push plate 60 and body 52 helping to secure the push plate 60 within body 52 and prevent it from falling out. Push plate 60 further includes a pair of pins 65 and 66 extending downwardly. As will be discussed below these pins are lined up with the pin 41 on the elevator platform 32. This allows the elevator platform to touch the push plate without directly contacting the product. Push plate 60 can be made from any number of materials including polypropylene and high density polyethylene.

Because the product 51 typically contains volatiles, it is necessary to have a means for sealing the top 53 and bottom 54 of cartridge 50 from the outside air, prior to use, in order to prevent their escape. In a preferred embodiment cartridge 51 includes a peelable film 62 that covers the bottom 54 of body 52., Film 62 is preferably a laminate film and can be made from any number of materials that will prevent volatiles in the product 51 from escaping. Such laminate materials are generally known in the art. The film is secured to the bottom of body 52 by any suitable adhesive. Furthermore, it is preferred that cartridge 51 come with a factory seal or inner cap 55 sealingly secured to the top 53 of body 52. The cartridge can then be sold as a single sealed unit. When the consumer is ready to use the cartridge they peel off film 62, insert the cartridge into the base, and remove inner cap 55, disposing of both the factory seal and the film.

In a preferred embodiment cartridge 50 further includes a means for releasably securing cartridge 50 within base 10. In one embodiment cartridge 50 has downwardly extending annular collar 70 that is designed to cover top 12 of base 10 and skirt over stepped section 21. To better secure cartridge 50 within base 10, collar 70 is provided with a pair of opposed inwardly extending protrusions 71 and 72 (not shown) that are designed to snap fit over beads 23 and 24 of base 10. This locks cartridge 50 into place. To release the cartridge 50 from base 10 the consumer would squeeze against ends 73 and 74 of collar 70. This would cause protrusions 71 and 72 to move outwardly. The consumer would then lift the cartridge 50 removing it from the base 10.

Annular collar 70 also keeps the base clean after successive cartridges. Upon application of the product 51 some of it may smear onto the package. If the base has smeared product on it, the consumer may be reluctant to use it again. With the use of collar 70, the product smears onto the cartridge, leaving the base clean and ready to receive another cartridge.

Figure 3:
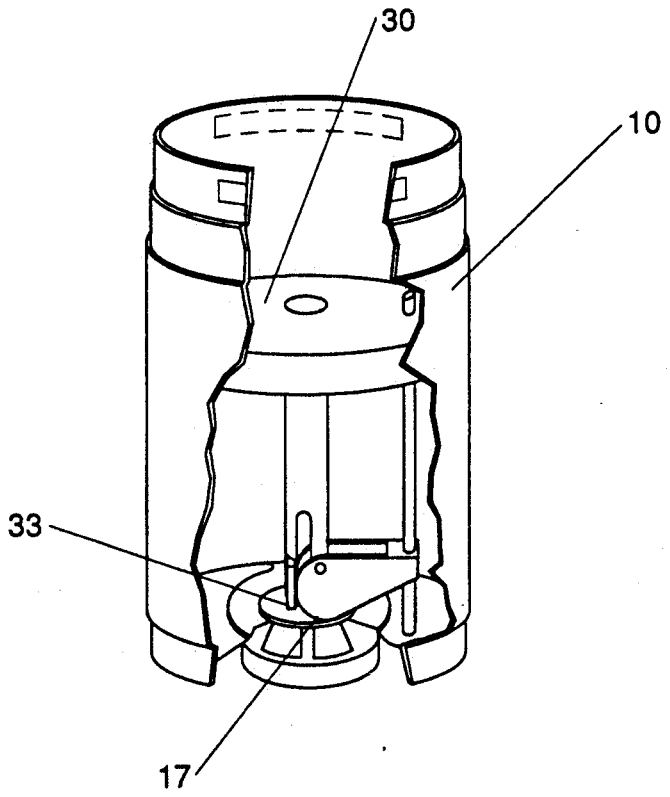
FIG. 3 is a perspective view of the base of the package of the present invention having a section cut away to show the elevator system in its lowermost position.

Package 1 further includes telescoping elevator system 30 disposed within base 10. Elevator system 30 includes internally threaded neck 31 and elevator platform 32. Internally threaded neck 31 is adapted to receive threaded shaft 15 in threaded telescoping relation. When package 1 is initially put together elevator 30 is in its lowermost position, as shown in FIG. 3. That is with the bottom 33 of neck 31 abutting against annular flange 17 of shaft 15. When cartridge 50 is inserted and locked in place, platform 32 will abut against push plate 60. Thereafter, when hand wheel 16 is turned in a predetermined direction (depending on the direction of the threads) threaded shaft 15 rotates so that elevator system 30 will move upwardly, whereby platform 32 will force push plate 60 up and push plate 60 will push the product 51 up and out of the package so that the consumer can have access to it.

Figure 6:
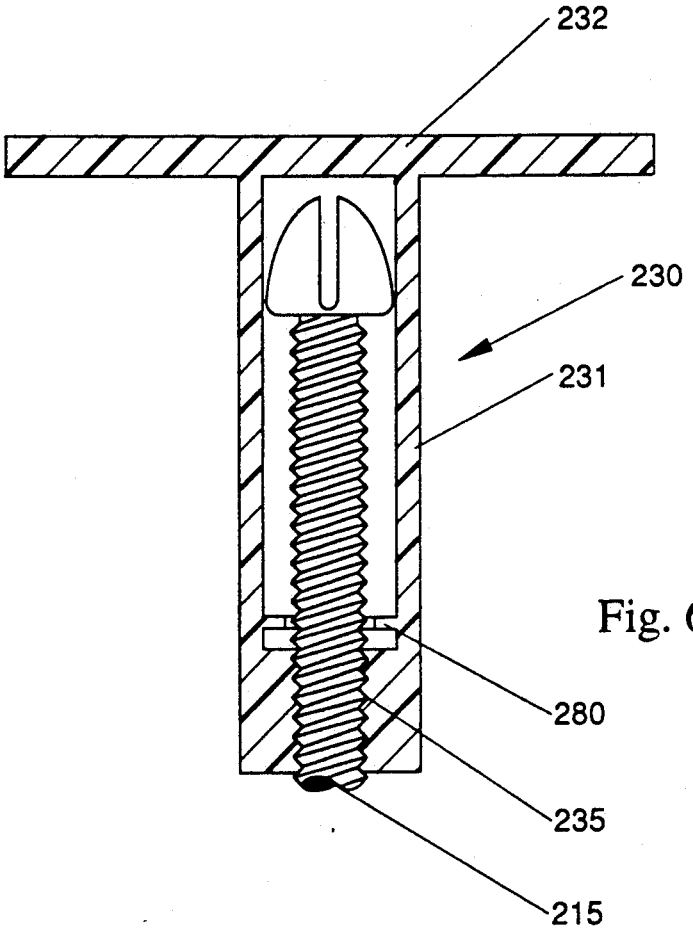
FIG. 6 is a simplified cross-sectional view of an alternative embodiment of the threaded shaft and elevator system of the present invention.

FIG. 6 shows an alternative embodiment of the elevator system of the present invention. FIG. 6 is a cross-section of elevator 230 engaging shaft 215. To prevent elevator 230 from disengaging the shaft and falling out of the base, shaft 215 has tapered bulb 229 disposed at its top end. When the elevator reaches the top, threads 235 will not advance past the bulb 229. Alternatively, elevator 230 could be provided with a ledge 280 above the threads, so as to engage the bulb 229 and prevent further advancement of the elevator. Bulb 229 is preferably split at its top so that it can be initially compressed in order to assemble the package. Bulb 229 could take the form of a toggle bolt or any other suitable shape.

Figure 7:
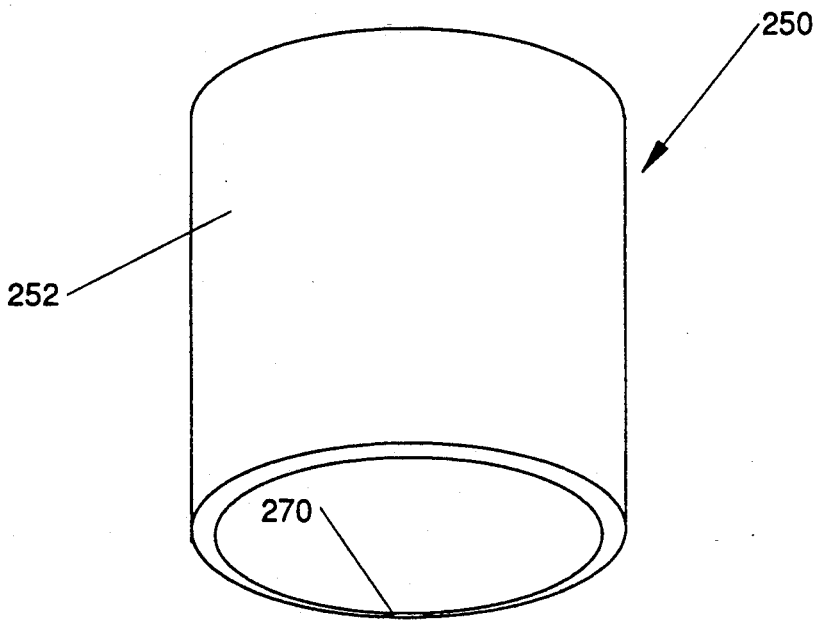
FIG. 7 is a simplified perspective of an alternative embodiment of the body of the cartridge of the present invention.

To help prevent the push plate 60 from falling out of the bottom of the cartridge, an annular ledge can be placed adjacent the bottom of the cartridge. FIG. 7 shows an alternative embodiment for the body 251 of cartridge 250 having annular ledge 270 adjacent its bottom edge. When removing an expended cartridge, as described above, the push plate may not come out with the cartridge but might stay in the reusable base. The annular ledge ensures that the push plate will be removed with the cartridge. Annular ledge 270 also provides more surface area for film 62 to adhere to the bottom. Annular ledge 270 should not prevent elevator 30 from extending through the cartridge 250 in order to advance the product.

After the product 51 is used up the cartridge 50 is removed, as described above, and thereafter thrown-away or recycled. At this time the elevator 30 is in its uppermost position. In order to fully insert a new cartridge into base 10, the elevator 30 must be reset to its lowermost position. One way to this is to turn the hand wheel 16 in a predetermined direction so that elevator 30 is lowered. However, it has been shown that consumers do not want to take the time to do this. Therefore, package 1 is provided with a means for resetting the elevator 30 to its lowermost position without manually rotating the hand wheel.

One way to reset the elevator would be to provide an elevator system wherein the internally threaded neck is split into at least two internally threaded sections adjacent its lower end. The package could then be provided with a means to move the sections outwardly from the shaft thereby disengaging the neck from the shaft. The elevator would then be free to move down to its lowermost position. Upon the elevator reaching its lowermost position, the sections would return to threaded engagement with the shaft. Two embodiments describing how this can be done are described below.

Figure 2:
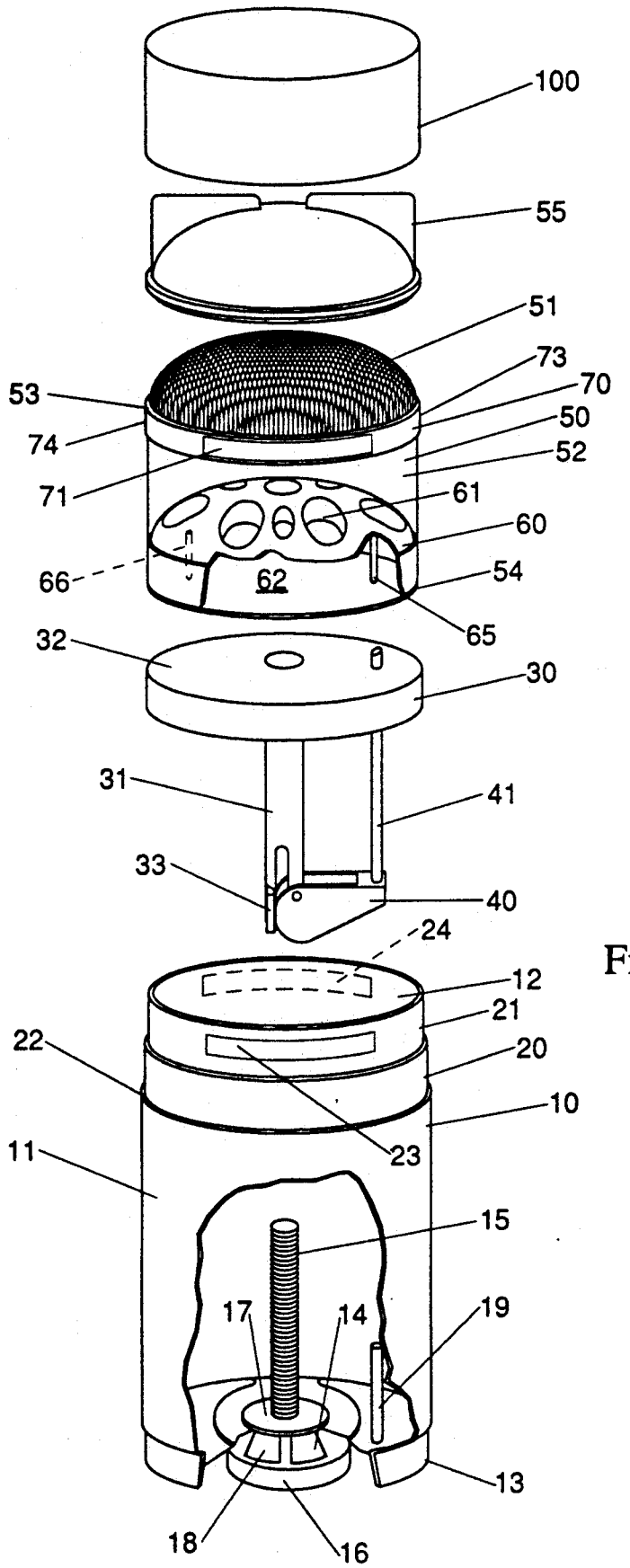
FIG. 2 is an exploded view of the package of the present invention.
Figure 4A:
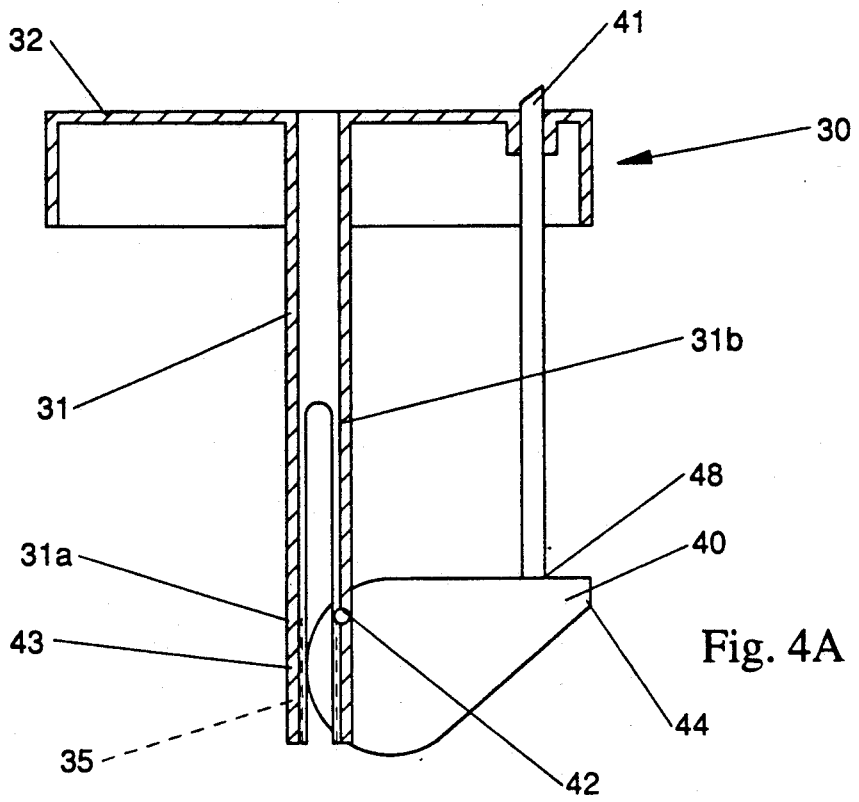
FIG. 4A is a sectional view of one embodiment of an elevator system of the present invention with the threads in their engaging position.

The elevator system 30 shown in FIGS. 1–3 uses a pin and lever system to reset the elevator. This can best be described by referring to FIGS. 4A and 4B where there is shown cross-sections of elevator system 30. Elevator system 30 has internally threaded neck 31 which is split into two halves **31*a* and 31*b*. Elevator system 30 further comprises lever 40 which is rotatably connected, between its to ends 43 and 44, to threaded neck half 31*b* by means of hinge 42. End 43 of lever 40 abuts against threaded neck half 31*a* whereas end 44 abuts against pin 41. FIG. 4A shows the elevator system as it would appear in its normal position, with the threads 35 engaging the shaft 15. For clarity the shaft 15** is not shown in the Figures.

Figure 4B:
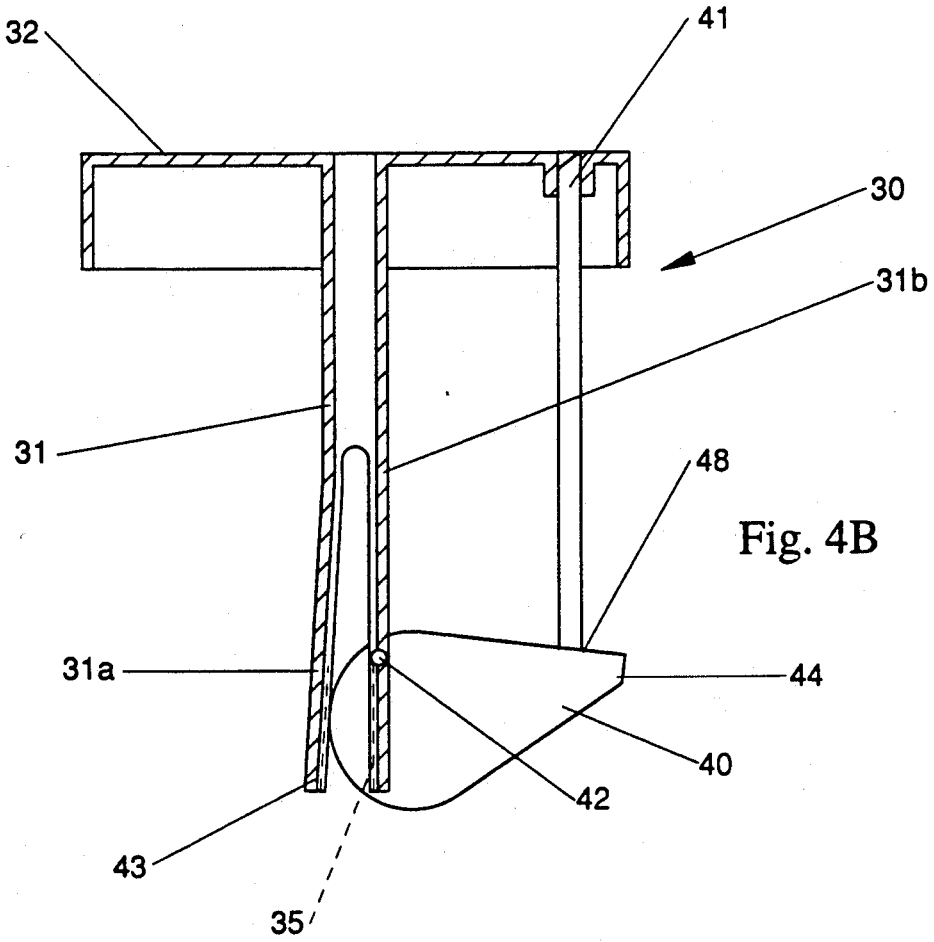
FIG. 4B is similar to FIG. 4A but with the threads in their disengaging position.

When the elevator 30 is in its uppermost position the pin 41 is in its up position as shown in FIG. 4A. When a consumer places a new cartridge into base 10, either pin 65 or 66 of push plate 60 will press against pin 41 and push it into its down position as shown in FIG. 4B. When pin 41 is pushed down, lever 40 rotates about hinge 42. End 43 of lever 40 is so situated that it pushes against half **31*a* of neck 31 spreading halves 31*a* and 31*b* far enough apart so that threads 35 disengage shaft 15. With pin 41 in its down position, the elevator system 30** can now be pushed down to its lowermost position.

Figure 8B:
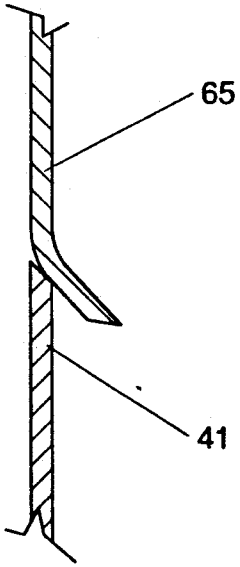
FIG. 8B is a similar view as FIG. 8A but showing the pins as they would appear with the cartridge locked in place.
Figure 8A:
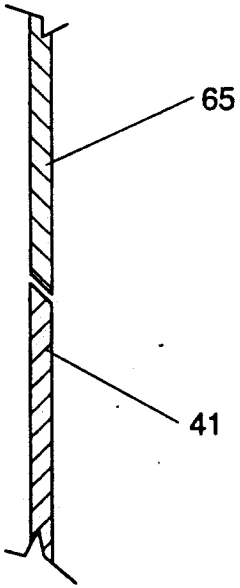
FIG. 8A is a simplified cross-section of pin 41 engaging pin 65.

As the elevator approaches its lowermost position, pin 41 contacts pin 19 of base 10 (shown in FIG. 2). Pin 19 pushes pin 41 to its up position and returns the lever to its original position. The internally threaded enough resiliency to return back to its original position, thereby re-engaging threads 35 with shaft 15. When the elevator is returned to its lowermost position, pin 19 may push pin 41 up to far. This would cause pin 41 to move pin 65 or 66 upwardly, causing push plate 60 to push up prematurely and may even cause it to tilt an angle. In order to prevent this p, 41 and pins 65 and 66 are angled at their ends, as shown in FIG. 8A, for this discussion assume that it is pin 65 that engages pin 41. Pin 65 is given sufficient resiliency so that when the elevator is in its lowermost position, pin 65 slides past pin 41 as shown in FIG. 8B.

Pin 41 and lever 40 are preferably of one piece construction molded from any suitable material such as polyethylene. The lever 40 and pin 41 are then bent at a right angle to form living hinge 48. Furthermore, because halves 31*a* and 31*b* are spread apart only near the bottom of neck 31, neck 31 is not threaded along its entire length but only near the bottom. Extra material may be added at the lower part of the threaded neck in order to improve its strength.

Figure 5A:
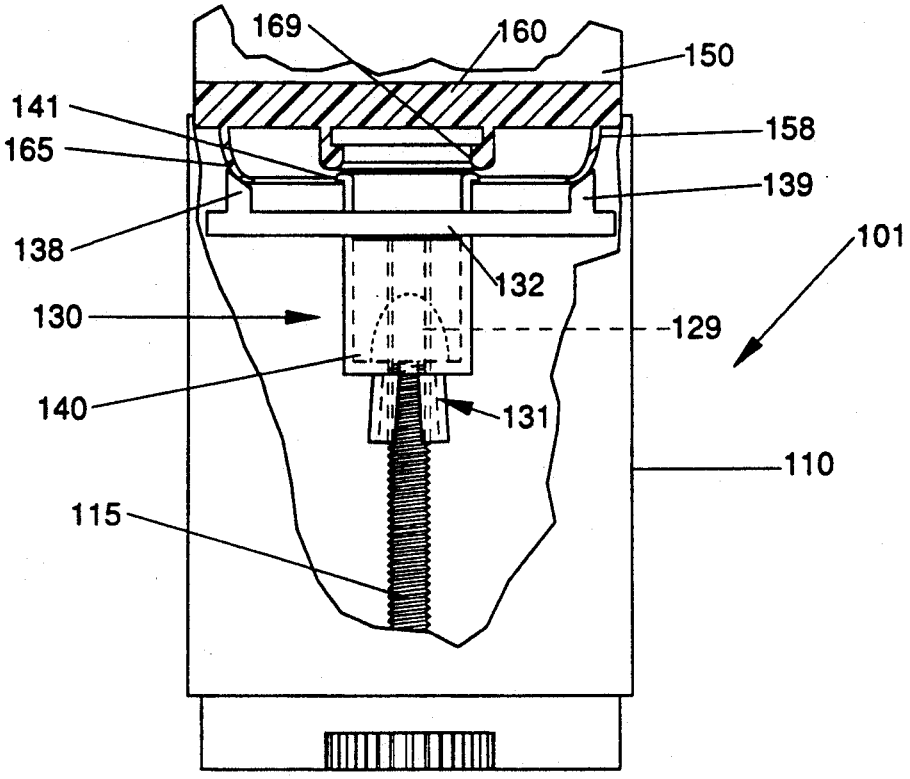
FIG. 5A is a cross-section of an alternative embodiment of the package of the present invention with elevator system 130 in its uppermost position.
Figure 5B:
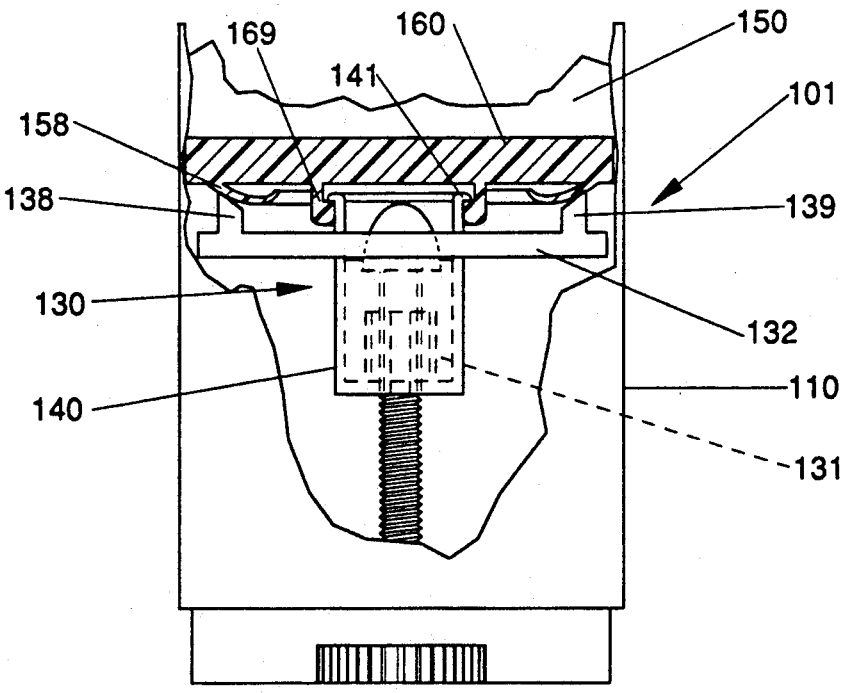
FIG. 5B is a similar view to FIG. 5A but with elevator system 130 in its lowermost position.

Another embodiment of the means for resetting the elevator without having to turn the handwheel is shown in FIGS. 5A and 5B where there is shown cross-sections of package 101 which is an alternative embodiment of the package of the present invention. Package 101 comprises base 110, telescoping elevator system 130 and cartridge 150 having push plate 160 disposed therein. Elevator system 130 comprises a split threaded neck 131, sleeve 140 and elevator platform 132. FIG. 5B shows the elevator 130 in its lowermost position. As seen from the figures push plate 160 has one or more fingers 169 which snap-fit over fingers 141 on sleeve 140. When elevator 30 is in its lowermost position sleeve 140 is fitted concentrically over split neck 131, biasing split neck 131 against shaft 115 so they are in threaded engagement.

FIG. 5A shows the elevator 30 in its uppermost position. When cartridge 150 is removed hooks 169 pull on hooks 141 which causes sleeve 140 to slide off of neck 131. With the sleeve removed split neck 131 is biased outwardly and is not in threaded engagement with shaft 115. This is accomplished by molding split neck 131 in an open position so that it has a tendency to be open when the sleeve is not covering it. A new cartridge can now be placed in base 110 and elevator system 130 will move freely downward towards its lowermost position. When the elevator is near its lowermost position, with neck 131 pressing against the bottom of base 110, the consumer will push down on the cartridge causing hooks 169 and 141 to engage and causing sleeve 140 to fit over neck 131 so that neck 131 is again threadably engaged with shaft 115. The consumer would hear sound such as a click that would inform them that the cartridge is in place and ready to be used.

Shaft 115 is provided with bulb 129 at its top to keep elevator 130 from sliding out of base 110 when cartridge 150 is removed. Cartridge 150 is provided with ledge 158, similar to the one shown in FIG. 7, to keep push plate 160 from sliding out of the cartridge and remaining engaged with elevator 130 when the cartridge 150 is removed. Push plate 160 has pins 165 and 166 which are similar to pins 65 and 66 of push plate 30. These pins engage pins 138 and 139 on platform 131 in the same fashion that pin 41 engages pin 65 described above and shown in FIGS. 8A and 8B.

Figure 9:
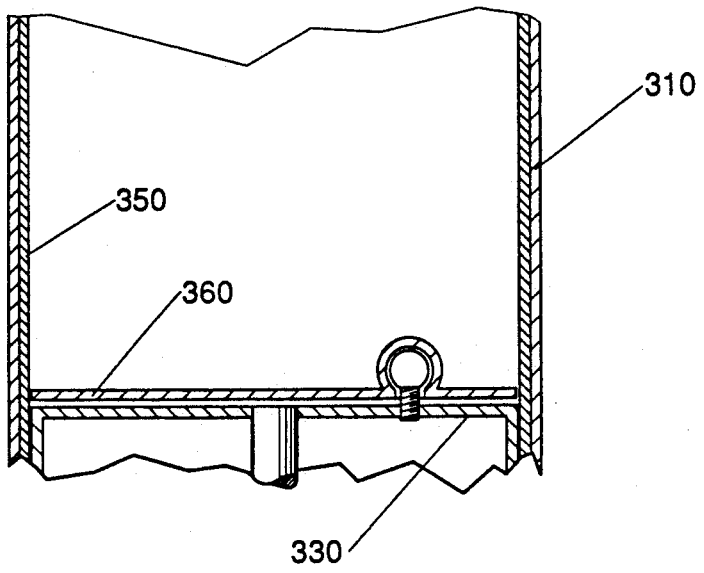
FIG. 9 is a simplified cross-section of an alternative embodiment of the present invention.

The elevator system shown in FIGS. 1-3 would not allow the user to retract the stick-form product back into the package. If the hand wheel is turned in the opposite direction of advancement the elevator 30 will retract but the push plate 60 and product 51 will stay where they are due to the friction between the push plate 60 and the cartridge body 52. To make the product retractable the package of the present invention could be provided with a means for allowing the elevator system to retract the product back into the cartridge. An example of this is shown in FIG. 9 where there is shown a simplified cross-section of an alternative embodiment of the package of the present invention. FIG. 9 shows cartridge 350 telescoped into base 310. Cartridge 350 push plate 360 abutting against elevator platform 330. As seen from the Figure platform 330 has a ball 337 designed to snap-fit into socket 367 on push plate 360. This ball and socket arrangement allows the elevator pull down the push plate 360 when the elevator lowered into the package. This allows the product to retract back into the cartridge.

While particular embodiments of the present invention have been illustrated and described various modifications will be apparent to those skilled in the art without departing from the spirit and scope of the present invention. Accordingly, the scope of the present invention should be considered in terms of the following claims and is understood not to be limited to the details described and shown in the specification and drawings.

What is claimed is:

1. An elevator/threaded shaft stick dispensing package for a solid stick-form product, said package having a cartridge designed to telescope into a base, said package comprising:

(a) said base, comprising a tubular body having an open top and a closed bottom having a central aperture disposed therein, said base having a threaded shaft axially oriented within its body and rotatably mounted on its bottom end through said central aperture wherein said shaft is connected to a hand wheel adjacent said bottom on the exterior of said body;

(b) said cartridge, comprising a tubular body for holding a solid stick-form product, said body having an open top and an open bottom, said bottom having a push plate disposed therein adjacent its bottom, said cartridge slidingly telescopes into said open top of said base;

(c) a telescoping elevator system disposed within said base, said elevator system comprising an internally threaded neck, adapted to receive said threaded shaft in threaded telescoping relation, and a platform above said neck designed to abut against said push plate of said cartridge, whereby when said hand wheel is turned in a predetermined direction said shaft rotates and advances said platform upwardly which advances said push plate upwardly and pushes said stick product out through said open top of said package; and (d) a means for resetting said elevator system to its lowermost position when it is in its uppermost position without manually rotating said hand wheel.

2. The package of claim 1 wherein said cartridge includes a downwardly extending annular collar adjacent its tip, said collar designed to skirt over said top of said base.

3. The package of claim 1 further including a means to secure said cartridge within said base.

4. The package of claim 2 further including a means to secure said cartridge within said base wherein said collar further includes at least one inwardly extending bead and said base includes at least one outwardly extending bead adjacent its top end, said beads being designed to snap fit over one another so as to secure said cartridge within said base.

5. The package of claim 1 wherein said push plate has a concave shape extending towards the top of said body of said cartridge, said push plate further including a plurality of apertures extending therethrough so as to adhere said stick-form product to said push plate.

6. The package of claim 1 wherein said base is made from polyethylene.

7. The package of claim 1 further including a cap to seal said top of said package when not in use.

8. The package of claim 1 wherein said package has a non-circular cross-section when taken perpendicular to said axially oriented shaft.

9. The package of claim 8 wherein said cross-section is oval.

10. The package of claim 1 further including a means to retract said product back into said cartridge.

11. The package of claim 1 wherein said internally threaded neck of said elevator system is split into at least two internally threaded sections adjacent its lower end, said means for resetting said elevator system thereby comprising a means for moving said sections outwardly from said shaft when said elevator system is in its uppermost position, thereby disengaging the threaded engagement between said neck and said shaft, said elevator system then being free to move down towards its lowermost position, said neck thereafter returning to threaded engagement with said shaft when said elevator system reaches its lowermost position.

12. The package of claim 11 wherein said neck is split into two internally threaded halves and said means for resetting said elevator system comprises:

(a) a pin extending through said platform and down towards said neck, said pin having an up position and a down position; and (b) a lever hingedly connected between its two ends to one of said halves of said neck by a hinge, one end of said lever abutting against said other half of said neck and the other end of said lever abutting against said pin, whereby when said cartridge is placed in said base it pushes said pin into its down position, thereby rotating said lever about said hinge and biasing said halves of said neck outwardly from said shaft disengaging said neck from said shaft, said elevator system now being free to move to its lowermost position, when said elevator system returns to its lowermost position said pin returns to its up position re-engaging said neck with said threads.

13. The package of claim 11 wherein said means for resetting said elevator system comprises a tubular sleeve concentrically fitting over said neck so that said neck is threadably engaged with said shaft, whereby when said elevator system is in its uppermost position and said cartridge is removed, said package has a means for moving said sleeve away from neck so as to disengage said neck from said shaft so that said elevator system can freely move to its lowermost position, when said elevator system reaches its lowermost position said sleeve is moved back over said neck so as to threadably re-engage said neck with said shaft.

14. An elevator/threaded shaft stick dispensing package for a solid stick-from product, said package having a cartridge designed to telescope into a base, said package comprising:

(a) said base comprising a tubular body having an open top and a closed bottom having a central aperture disposed therein, said base having a threaded shaft axially oriented within its body and rotatably mounted on its bottom end through said central aperture wherein said shaft is connected to a hand wheel adjacent said bottom on the exterior of said body;

(b) said cartridge comprising a tubular body for holding a solid stick-form product, said body having an open top and an open bottom, said cartridge having a push plate disposed therein adjacent its bottom, said push plate having a concave shape extending towards the top of said body of said cartridge, said push plate further including a plurality of apertures extending therethrough so as to adhere said stick-form product to said push plate, said cartridge slidingly telescopes into said open top of said base;

(c) a telescoping elevator system disposed within said base, said elevator system comprising an internally threaded neck split into two internally threaded halves adjacent its bottom, said neck adapted to receive said threaded shaft in threaded telescoping relation, said elevator system further including a platform above said neck designed to abut against said push plate of said cartridge, whereby when said hand wheel is turned in a predetermined direction said shaft rotates and advances said platform and said push plate thereby pushing said stick product out through said open top of said package; and (d) a means for resetting said elevator system to its lowermost position when it is in its uppermost position without manually rotating said hand wheel, said means comprising:

(i) a pin extending through said platform and down towards said neck, said pin having an up position and a down position; and (ii) a lever hingedly connected between its two ends to one of said halves of said neck by a hinge, one end of said lever abutting against said other half of said neck and the other end of said lever abutting against said pin, whereby when said cartridge is placed in said base it pushes said pin into its down position, thereby rotating said lever about said hinge and biasing said halves of said neck outwardly from said shaft disengaging said neck from said shaft, said elevator now being free to move to its lowermost position, when said elevator returns to its lowermost position said pin returns to its up position re-engaging said neck with said shaft.

* * * * *

UNITED STATES PATENT AND TRADEMARK OFFICE

CERTIFICATE OF CORRECTION

PATENT NO. : 5,255,990

DATED : October 26,1993

INVENTOR(S) : A. H. Dombusch et al

It is certified that error appears in the above-indentified patent and that said Letters Patent is hereby corrected as shown below:

On the title page:

*In the ABSTRACT section, last line, delete "wheels" and insert therefor -- wheel --.*

*Column 1, line 22, delete "pending" and insert therefor -- co-pending --.*

*Column 2, line 65, after "an", second occurrence, insert -- open --.*

*Column 2, line 66, after "has" insert -- a --.*

*Column 4, line 47, delete "t" and insert therefor -- open top --.*

*Column 4, line 49, delete "i".*

UNITED STATES PATENT AND TRADEMARK OFFICE

CERTIFICATE OF CORRECTION

PATENT NO. : 5,255,990

DATED : October 26, 1993

INVENTOR(S) : A.H. Dombusch et al

It is certified that error appears in the above-indentified patent and that said Letters Patent is hereby corrected as shown below:

*Column 5, line 6, delete ",".*

*Column 6, line 68, after "threaded" insert – neck has – .*

*Column 7, line 7, delete "p" and insert therefor – pin – .*

*Column 8, line 17, after "elevator" insert – to – .*

*Column 8, line 65, Claim 2, delete "tip" and insert therefor – top – .*

*Column 10, line 7, Claim 14, delete "from" and insert therefor – form – .*

Signed and Sealed this

Sixth Day of June, 1995

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,255,990

DATED : October 26, 1993

INVENTOR(S) : A. H. DORNBUSCH ET AL.

It is certified that error appears in the above-identified patent and that said Letters Patent is hereby corrected as shown below:

Column 1, line 56, delete "a", second occurrence.

Column 2, line 22, delete "of", second occurrence.

Column 3, line 21, delete "cartridge", second occurrence.

Column 3, line 38, delete "a" and insert therefor -- an --.

Column 6, line 22, after "to" insert -- do -- .

Column 6, line 47, delete "to".

Column 7, line 53, after "hear" insert -- a -- .

Column 8, line 17, after "elevator" insert -- to -- .

Column 8, line 18, after "elevator" insert -- is -- .

Signed and Sealed this

Thirty-first Day of October 1995

Bruce Lehman

*Attest:*

BRUCE LEHMAN

*Attesting Officer*

*Commissioner of Patents and Trademarks*